United States Patent [19]

Brewer

[11] Patent Number: 4,685,888

[45] Date of Patent: Aug. 11, 1987

[54] OUTBOARD MOTOR SUPPORT

[76] Inventor: Frank Brewer, 10470 SW. 203 Ter., Miami, Fla. 33189

[21] Appl. No.: 713,258

[22] Filed: Mar. 18, 1985

[51] Int. Cl.[4] ..... B63H 5/12

[52] U.S. Cl. ..... 440/53; 440/900; 248/640; 248/642; 188/321.11

[58] Field of Search ..... 440/53, 55, 61, 900; 248/640–643, 354.6; 298/17 B; 280/414.1, 414.3; 267/138, 151, 170, 177, 178, 136, 139, 71, 8 R; 188/321.11

[56] References Cited

U.S. PATENT DOCUMENTS

| | | | |
|---|---|---|---|
| 3,173,644 | 3/1965 | Burfiend | 267/170 X |
| 3,382,839 | 5/1968 | Kiekhaefer | 440/55 |
| 3,952,986 | 4/1976 | Wells | 248/642 |
| 4,321,988 | 5/1982 | Bich | 188/322.11 |
| 4,331,431 | 5/1982 | Estes | 440/53 |
| 4,521,002 | 6/1985 | Adorjan et al. | 267/170 |
| 4,521,202 | 6/1985 | Nakahama | 440/55 |

FOREIGN PATENT DOCUMENTS

| | | | |
|---|---|---|---|
| 1394137 | 2/1965 | France | 188/321.11 |

*Primary Examiner*—Joseph F. Peters, Jr.
*Assistant Examiner*—Edwin L. Swinehart
*Attorney, Agent, or Firm*—Malin, Haley & McHale

[57] ABSTRACT

Disclosed herein is a shock arm adapted to be mounted between a trailer and the shaft of an outboard motor attached to a boat carried by the trailer. The shock arm includes a lower member rigidly affixed to the trailer frame and an upper member having a V-shaped and adapted to receive the motor shaft. Between the lower and upper ends is a shock absorber which absorbs the shock of the motor whenever the trailer hits a bump in the road. A hydroelectric tilt mechanism, may be provided as a part of the motor to return the compressed shock absorber to the normal position or a spring may be included with the shock absorber to cause it to return to the normal position.

2 Claims, 4 Drawing Figures

OUTBOARD MOTOR SUPPORT

This invention relates to an outboard motor support and more particularly to such a support for holding an outboard motor in a fixed tilted position while the boat on which the motor is attached is being carried by a trailer.

For many years boats have been fabricated with the idea that an outboard motor would be attached to the transom thereof to power the boat. In many instances the outboard motor is very heavy and cannot readily be removed from the transom of the boat once it is attached. For this reason, the transoms are built of sufficient strength to accomodate transporting the boat with the motor attached while carried on a conventional boat trailer. In order to minimize the stresses on the transom, as the boat and motor are hauled over roads, the motor is generally placed in the vertical position. In this manner whenever trailer hits a bump and boat and trailer bounce as a result of the bump, the forces from the moving motor are directed vertically downward on the transom. However a problem exists in that the bottom of the motor may strike the ground causing damage either to the motor shaft or to the transom of the boat.

To avoid the problem of the motor striking the ground it has been proposed in the past to brace the motor in a tilted position. For example, in the U.S. Pat. No. 3,693,576 a motor brace is shown attached between the trailer frame and the motor shaft for holding the motor in a tilted position. In this position as the boat and motor bounce up and down, the forces are still directed primarily in a vertical direction so as not to shear the transom. The problem with the device shown in U.S. Pat. No. 3,693,576 is as the boat and trailer bounce, they tend to separate. This causes the motor to tilt to compensate for the separation, thereby causing shear stress on the transom. Because of the rigid connection between the trailer and the shaft of the motor, as the boat and trailer return to a normal position, additional shear stress is placed on the transom of the boat.

It would be preferable to have a supporting device between the trailer and the motor which can absorb much of the shock created when the trailer hits a bump causing relative movement between the trailer and the boat and motor.

In accordance with one aspect of this invention, there is provided an outboard motor engine shock arm for connection between a motor engine shaft and boat trailer while the shaft extends from the transom of a boat carried by the trailer. The arm holds the engine in an angular position relative to the transom. The shock arm comprises lower means rigidly affixed to the trailer and upper means adapted to being affixed to the shaft. In addition, the shock arm comprises shock absorber means connected between the lower means and the upper means.

One preferred embodiment of the subject invention is hereafter described, with specific reference being made to the following Figures, in which:

FIG. 1. shows a motor affixed to the transom of a boat and held in an angular position by the shock arm of the subject invention;

Figure 1:
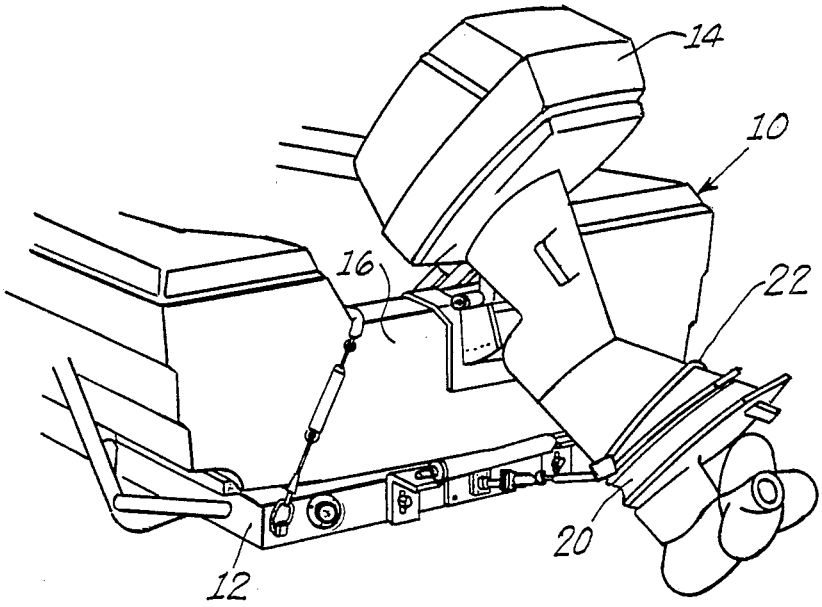
Figure 4:
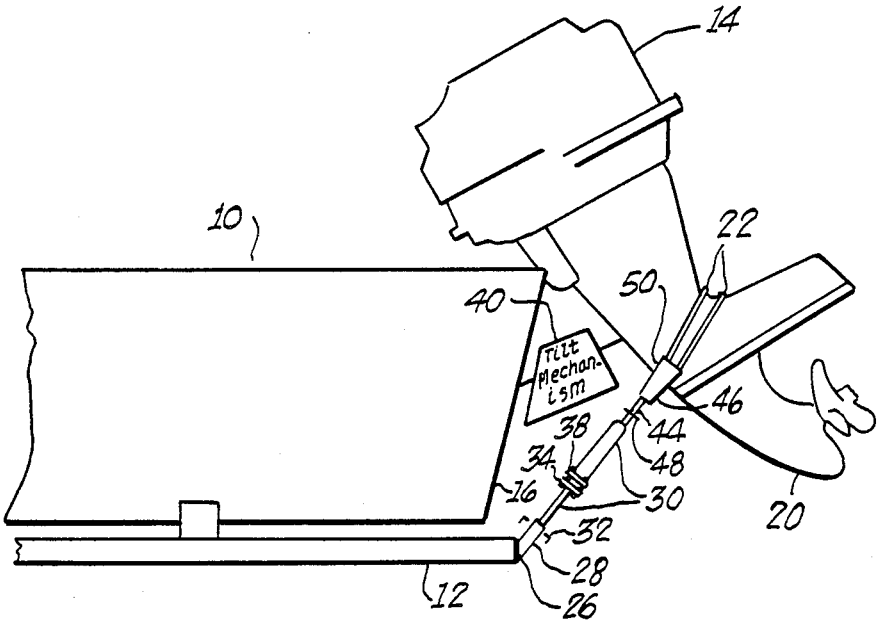
FIG. 4 shows a partial side elevational view with block diagram of a conventional hydraulic tilt mechanism.

Referring now to FIG. 1, a boat 10 is shown carried on a boat trailer 12 and having an outboard motor 14 affixed to the center of the transom 16 of the boat 10. Motor 14 is shown in a tilted position and typically may be placed in this position through the use of a hydroelectric tilt mechanism 40, as seen in FIG. 4, associated with motor 14. Such mechanisms are found on conventional outboard motors and generally operate as a spring holding the motor in the position as shown in FIG. 1.

Motor 14 is also maintained in the tilted position by the use of shock arm 18 which is attached between trailer 12 and the shaft 20 of motor 14. One end of shock arm 18 is secured to trailer 12, and the other end is firmly attached to shaft 20 of motor 14 by strap 22. Shock arm 18 includes a shock absorbing means to minimize stress forces on transom 16 whenever trailer 12 hits a bump in the road.

Figure 2:
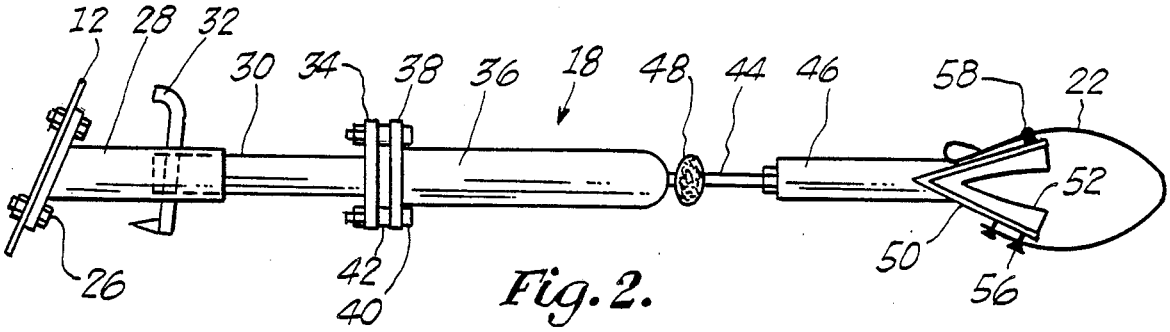
FIG. 2 shows a more detailed drawing of the shock arm of the subject invention.

Referring now to FIG. 2, the detailed construction of shock arm 18 is shown. On the end of shock arm 18 closest to trailer 12 is a flange 26 adapted to being bolted to the frame of trailer 12. Extending at an angle from flange 26 is an outer member 28 which may be a hollow cylindrical pipe or the like. An inner member 30 is slidable within outer member 28 and can be held at a fixed position therein by a pin 32. Constructed in this manner with inner member 30 sliding into or out from outer member 28, the overall length of shock arm 18 can be changed to accomodate different size motors 14 boats 10 or trailers 12. On the end of inner member 30 remote from outer member 28 is a second flange 34 positioned generally perpendicular to the direction of inner member 30.

A conventional shock absorber 36 for damping substantial up and down movement of motor shaft 20 which has a flange 38 on the bottom thereof is affixed by bolts 40 to flange 34. Between flanges 34 and 38 is positioned an elastic material, such as a rubber washer 42. Extending from the other end of shock absorber 36 is a piston rod 44 having a threaded end remote from shock absorber 36. Piston rod (44) extends into shock absorber 36 in the conventional sealed manner to the conventional piston member within shock absorber 36.

An upper member 46 may be secured to the threads of piston rod 44. Another elastic material such, as a rubber washer 48, is positioned around piston rod 44 to absorb the shock of upper member 46 being forced against shock absorber 36.

The end of upper member 46 remote from piston rod 44 has a V member 50 formed therein and V-member 50 has a V-shaped rubber bumper 52 on the inner side thereof. The shape of the V of both member 50 and bumper 52 is designed to receive the generally V-shaped front surface of motor shaft 20 as shown in FIG. 1. Strap 22 which is held by strap connectors 56 and 58, is adapted to be wrapped around motor shaft 20 as shown in FIG. 1. Connectors 56 hold one end of strap 22 fixed and connector 58 is of the type that would permit the strap 22 to slide therethrough for adjustment in order to fit securely around different sizes of motor shaft 20. Said hydroelectric tilt mechanism or said spring is associated with motor 14 and may be positioned between transom 16 and motor 14 for biasing said motor 14 and shaft 20 in the tilted position as shown in FIG. 1. When motor 14 and shaft 20 are in said tilted position said shock absorber piston is approximately midway within its chamber 36 and therefore is free to move a substantial distance in either direction in response to a jar or jolt caused by trailer 12 striking an irregularity in the road. From the above it can be seen that shock absorber piston rod 44 is in an extended position when trailer 12 is at rest, best seen in FIGS. 1 and 4.

In operation, shock arm 18 is positioned between trailer 12 and the motor shaft 20 as shown in FIG. 1. When the trailer hits a bump in the road, causing the boat and/or trailer to bounce, the additional pressures which otherwise would be placed by the motor on the transom are absorbed by shock absorber 36. This prevents large swings in the movement of motor shaft 20 relative to boat 10. If motor 20 includes a hydroelectric tilt 70 or other spring device for maintaining motor 14 in the tilted position, such device automatically returns motor 20 to the position shown in FIG. 1. Shock absorber 36 acts to slow this return movement in the same manner as it slowed the initial movement due to hitting the bump.

Figure 3:
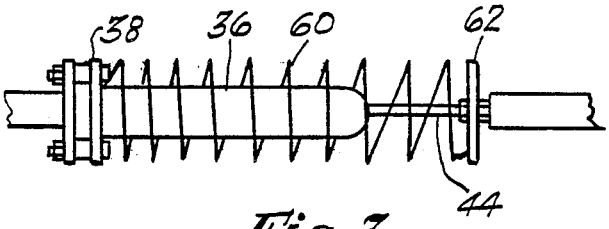
FIG. 3 shows an alternate embodiment for the shock absorbing portion of the shock arm of the subject invention.

In the event motor 14 is not equipped with a hydroelectric tilt mechanism 70 or other such device, it is necessary to provide other mechanisms to return shock absorber 30 to its normal extended position. In FIG. 3 for example, a spring 60 is positioned around shock absorber 36. One end of spring 60 is held by flange 38 and the other is held by a spring plate or flange 62 affixed on piston rod 44. Whenever piston rod 44 moves into shock absorber 36 due to compression forces thereon, spring 60 thereafter forces rod 44 back out of shock absorber 36 to the normal position.

Likewise if motor 14 is moved upward by motion of trailer 12 caused by an irregularity in the road surface piston rod 44 will be pulled out of shock absorber 36 due to tensile forces thereon, the weight of engine 14 thereafter forcing rod 44 back into shock absorber 36 to the normal position.

What is claimed is:

1. An outboard motor support arm for being connected between a lower unit of an outboard motor and a boat trailer while said lower unit extends from the transom of a boat carried by said trailer, said support holding said motor in an angular position relative to said transom and allowing relative angular damping movement of said lower unit with respect to said transom and trailer, said movement for damping vibrations brought on by undulations in the surface being travelled by said trailer, said support arm comprising lower means rigidly affixed to said trailer for connecting said support arm to said trailer;

upper means adapted to being removably fixed to said lower unit of said outboard motor;

shock absorber means connected between said lower means and said upper means for damping road bump induced movement of said outboard motor, said shock absorber means includes a cylinder having an internal piston and a piston arm connected thereto and passing external to said cylinder, said piston and piston arm being slidable between an extended position and a retracted position relative to said cylinder, means being provided within said cylinder to dampen the motion of said piston;

said shock absorber means further including force means acting to retain said motor in a normal, at rest, position relative to said transom when said trailer is not acted upon by road bumps, and to return said motor to said normal position after said trailer is acted upon by road bumps.

2. The outboard motor support arm of claim 1, wherein:

said force means is a coil-over spring positioned coaxially around the piston arm/cylinder arrangement, and retained in position therein by first and second flange means, said first flange means being connected to the end of said shock absorber means closest to said lower means, said second flange means being connected to the end of said shock absorber closest to said upper means.

* * * * *